US008960159B2

(12) United States Patent
Jones et al.

(10) Patent No.: US 8,960,159 B2
(45) Date of Patent: Feb. 24, 2015

(54) DRAIN FOR FUEL PUMP

(75) Inventors: Christopher Robert Jones, Washington, IL (US); Stephen Robert Lewis, Chillicothe, IL (US); Eric Lee Rogers, El Paso, IL (US); Venkata R. Tatikonda, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 274 days.

(21) Appl. No.: 13/563,029

(22) Filed: Jul. 31, 2012

(65) Prior Publication Data

US 2014/0034018 A1 Feb. 6, 2014

(51) Int. Cl.
*F02M 37/06* (2006.01)
*F01M 11/02* (2006.01)

(52) U.S. Cl.
CPC ..... *F02M 37/06* (2013.01); *F01M 11/02* (2013.01)
USPC ..... 123/508; 123/198 DA; 123/37

(58) Field of Classification Search
USPC ..... 123/508, 198 DA, 198 C, 198 R, 90.34; 184/6.5
See application file for complete search history.

(56) References Cited

U.S. PATENT DOCUMENTS

| | | | | |
|---|---|---|---|---|
| 6,112,726 | A | 9/2000 | Saito et al. | |
| 6,722,864 | B2 | 4/2004 | Suzuki et al. | |
| 7,107,967 | B2 | 9/2006 | Sano | |
| 7,444,989 | B2 | 11/2008 | Shafer et al. | |
| 7,690,353 | B2 | 4/2010 | Shafer et al. | |
| 7,819,107 | B2 | 10/2010 | Stockner et al. | |
| 8,197,230 | B2 | 6/2012 | Schell et al. | |
| 2004/0011314 | A1* | 1/2004 | Seader et al. | 123/90.34 |
| 2009/0159053 | A1* | 6/2009 | Stockner et al. | 123/495 |
| 2010/0071655 | A1* | 3/2010 | Kim | 123/196 R |
| 2010/0126460 | A1* | 5/2010 | Lee | 123/196 R |
| 2010/0139610 | A1* | 6/2010 | Park | 123/196 R |
| 2011/0100319 | A1* | 5/2011 | Shin | 123/196 R |
| 2011/0126793 | A1* | 6/2011 | Ahn | 123/196 R |
| 2011/0214642 | A1 | 9/2011 | Shafer et al. | |

FOREIGN PATENT DOCUMENTS

| | | | |
|---|---|---|---|
| CN | 201818412 | U | 5/2011 |
| EP | 1 363 016 | A2 | 11/2003 |
| EP | 1 780 415 | A1 | 5/2007 |

* cited by examiner

*Primary Examiner* — Mahmoud Gimie
(74) *Attorney, Agent, or Firm* — Miller, Matthias & Hull

(57) ABSTRACT

A fuel pump and method for draining such and for providing a lubrication fluid sump level for startup of the fuel pump are disclosed. The fuel pump may comprise a housing, a first plunger apparatus, and a camshaft rotatably mounted in the housing. The camshaft has a first end and a second end and may define a bore extending from the first end to the second end. The camshaft may include a first interface operatively connected to the first plunger apparatus.

19 Claims, 4 Drawing Sheets

DRAIN FOR FUEL PUMP

TECHNICAL FIELD

The present disclosure generally relates to fuel pumps and, more particularly, relates to the draining of lubrication oil from fuel pumps, particularly those pumps used in common rail fuel systems for internal combustion engines, and the like.

BACKGROUND

A fuel pump utilizes oil or other like fluid (herein referred to as "lubrication fluid") for the lubrication of moving components enclosed within the pump housing. In traditional fuel pumps with oil lubricated lower ends, such as those utilized in common rail fuel systems, oil is provided to the fuel pump by a pressurized feed and is drained out the driven end of the pump housing. Often, this end of the housing mates with either the front or rear housing of the engine. Thus, oil drained out of the fuel pump is returned to the engine pan.

Each pump typically has a driven gear mounted on a central camshaft that extends out of the pump housing. The camshaft is usually mounted in a bearing journal. The driven gear is driven by a mating drive gear connected either directly, or indirectly, to the engine drive train/crankshaft. To allow for oil drainage out of the fuel pump, holes are drilled in the pump housing. The placement of the holes must be outside of the bearing journal diameter for the camshaft. Typically, the holes are drilled to the right, to the left, or below the camshaft. Various size and positional constraints may cause the holes to be positioned adjacent to the meshing of the teeth of the driven gear and the mating drive gear.

The height of the drain holes in the pump housing determines the amount of oil or lubrication fluid that remains in the pump housing after the engine has shut down ("sump level"). Some level of lubrication fluid in the pump housing is desired for the cooling of components during start-up of the pump. Due to economies of scale, the same pump may be utilized on different engines. The positioning of the fuel pump on each of these different engines may vary. For example, while on some engines the fuel pump may be mounted in a vertical position, on other engines the fuel pump may need to be mounted such that the fuel pump is rotated clockwise or counterclockwise from the vertical position. Such situations may result in a drain hole being positioned below the desired sump level. As a consequence, a lower than desired sump level of lubrication fluid in the pump housing will occur. The lower position of the drain hole also increases the possibility that any debris that may have sunk to the lower portion of the pump housing will flow out of the lower drain hole and into the meshing of the teeth of the drive and driven gears.

U.S. Pat. No. 6,112,726 ("Saito et al.") issued Sep. 5, 2000 is an example of prior art related to fuel pumps. FIGS. 7-8 of Saito et al. disclose a fuel pump 111 encased in a housing 155. The lower wall of this housing 155 has a drain passage 158 that drains lubricant back to an oil reservoir 160. Disadvantageously, the drain position of Saito et al. increases the likelihood that debris within the housing may block the drain. A better design is needed.

SUMMARY OF THE DISCLOSURE

In accordance with one aspect of the disclosure, a fuel pump is disclosed. The fuel pump may comprise a housing, a first plunger apparatus, and a camshaft rotatably mounted in the housing. The camshaft has a first end and a second end and may define a bore extending from the first end to the second end. The camshaft may include a first interface operatively connected to the first plunger apparatus.

In accordance with another aspect of the disclosure, a fuel system is disclosed. The fuel system may comprise an engine including a plurality of fuel injectors, a drive gear operatively connected to the engine, a common fuel rail operatively connected to the fuel injectors, and a fuel pump including a housing, a first plunger apparatus operatively connected to the common rail, a camshaft rotatably mounted in the housing, and a driven gear. The camshaft may have a first end and a second end and may define a bore extending from the first end to the second end. The camshaft may include a first interface operatively connected to the first plunger apparatus. The drive gear may be disposed outside of the pump housing and may be mounted on the second end of the camshaft and meshed with the drive gear.

In accordance with a further aspect of the disclosure, a method of providing a lubrication fluid sump level for the start-up of a fuel pump is disclosed. The method may comprise accumulating lubrication fluid in a housing of the fuel pump, receiving, through an entrance port, accumulated lubrication fluid into a bore in a camshaft, and draining the accumulated lubrication fluid out an exit port of the bore. The camshaft may be rotatably mounted in the fuel pump and may have a first end and a second end. The entrance port of the bore may be disposed at the first end of the camshaft and the exit port may be disposed at the second end of the camshaft.

DETAILED DESCRIPTION

Figure 1:
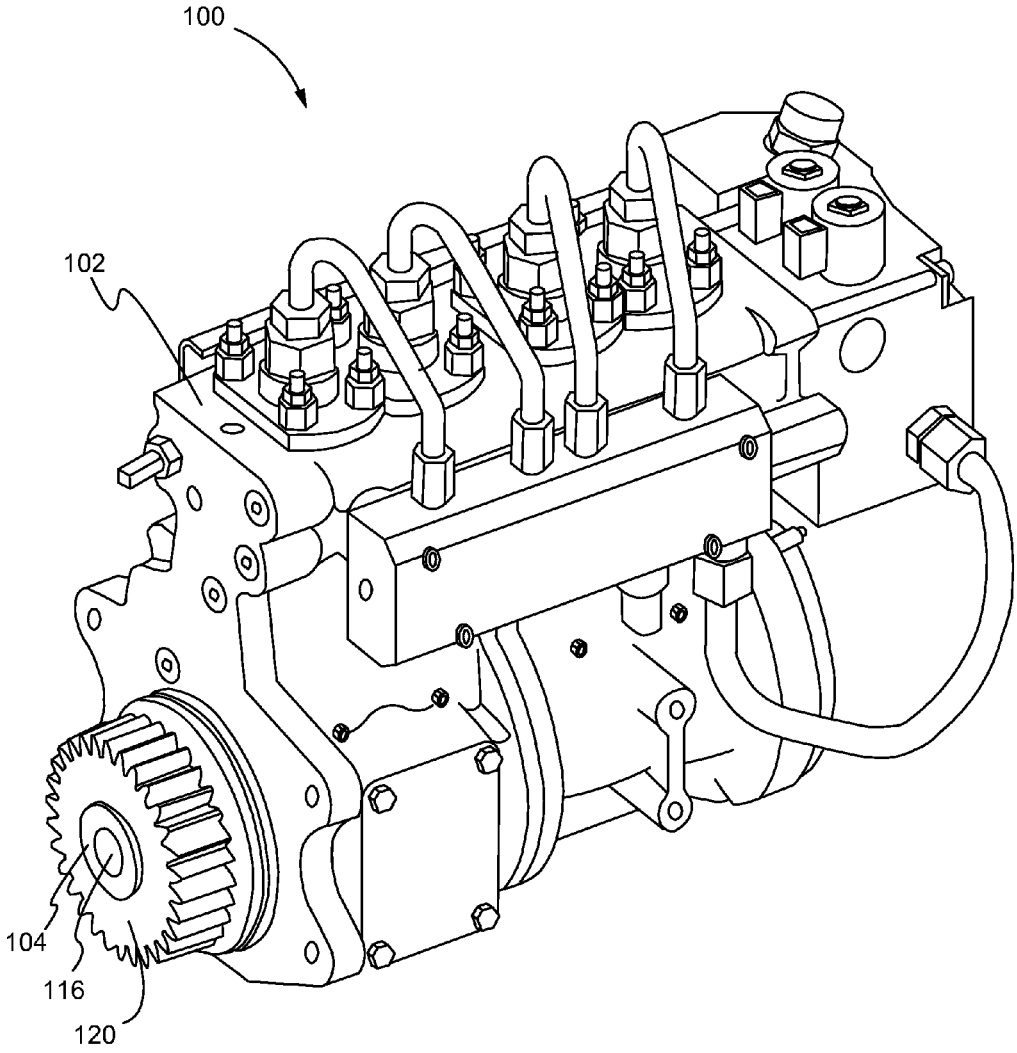
FIG. 1 is a perspective view of one embodiment of a fuel pump constructed in accordance with the teachings of this disclosure.

Referring now to the drawings, and with specific reference to FIG. 1, there is shown a perspective view of one embodiment of an exemplary fuel pump constructed in accordance with the present disclosure and generally referred to by reference numeral 100. While the following detailed description and drawings are made with reference to a fuel pump 100 utilized in a common rail fuel system, the teachings of this disclosure may be employed on fuel pumps in other types of fuel systems in which it is desired to provide a lubrication fluid sump level within the fuel pump (housing 102) for desired lubrication of components.

Figure 2:
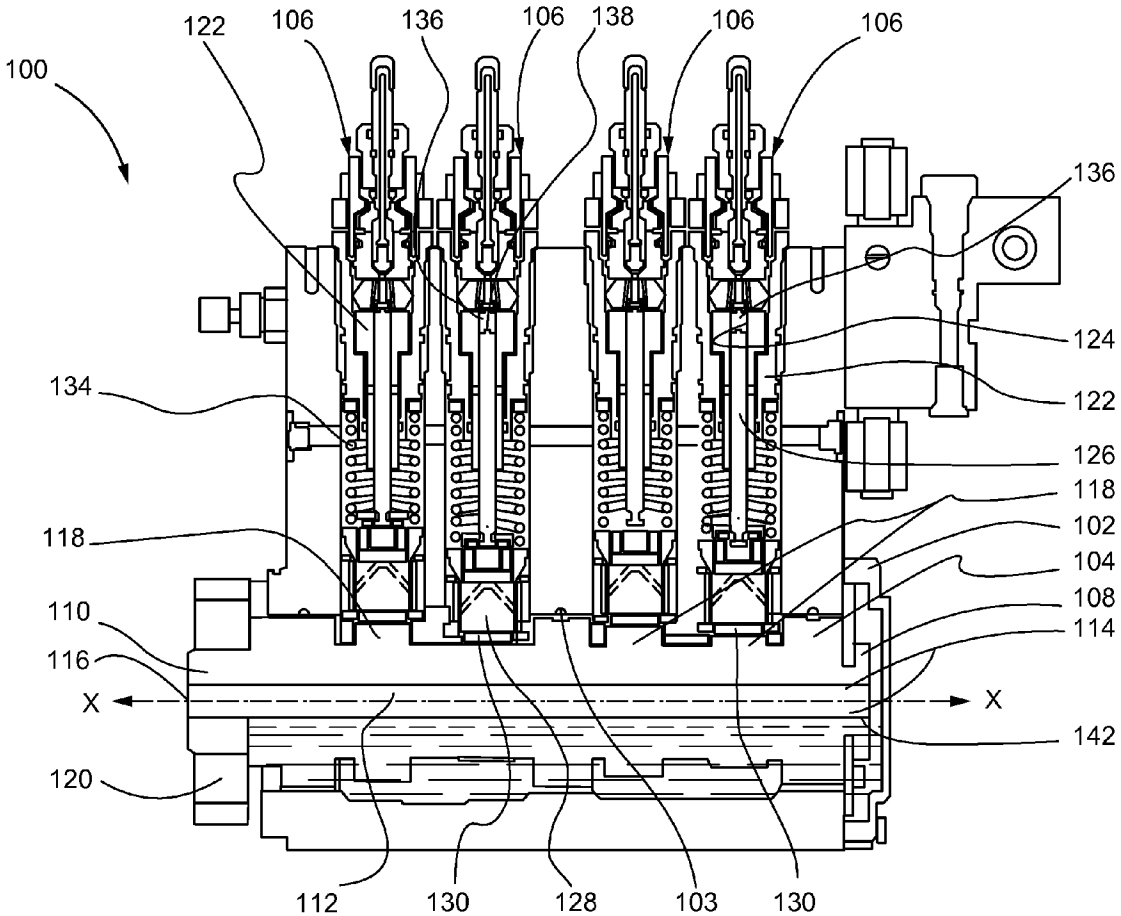
FIG. 2 is a cross-sectional view of the fuel pump of FIG. 1.
Figure 3:
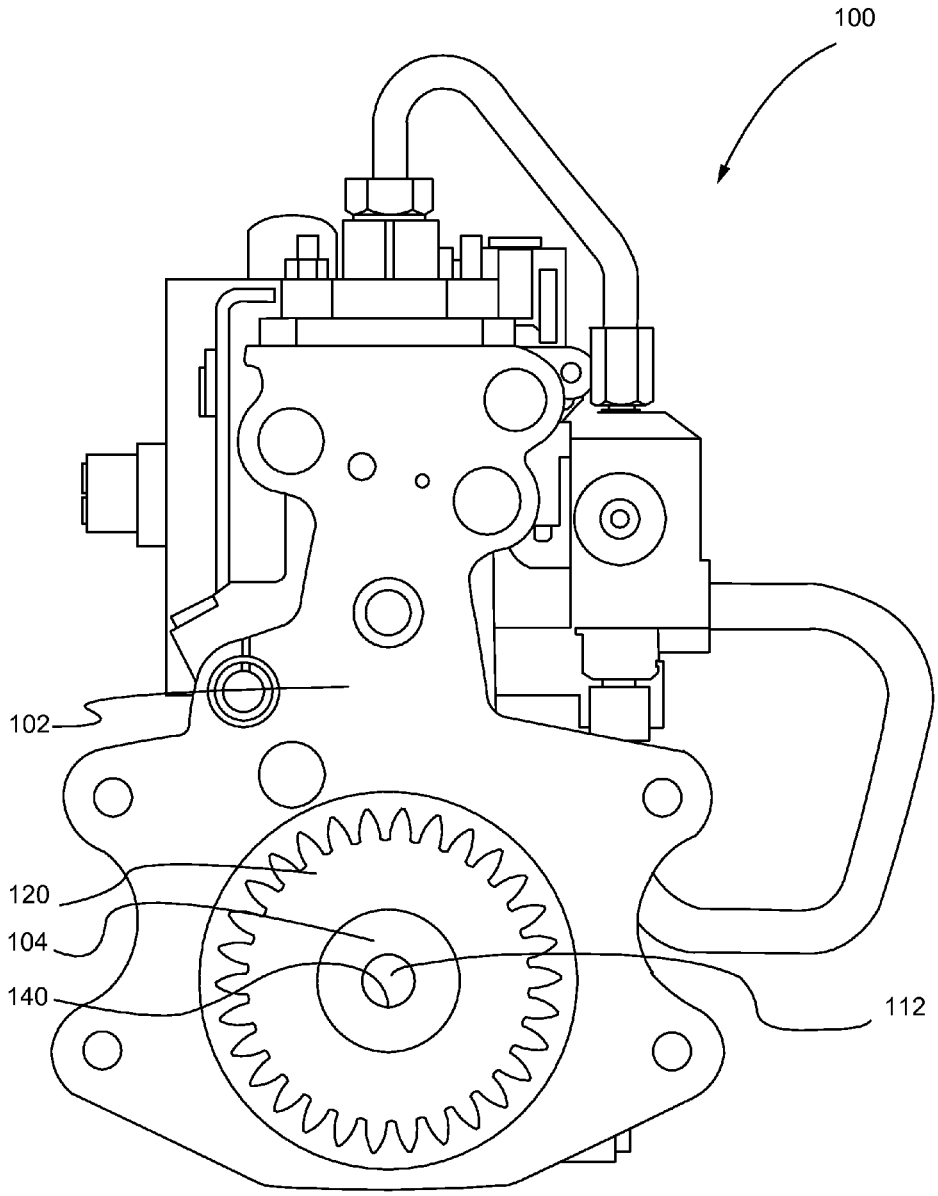
FIG. 3 is a side view of the driven end of the fuel pump of FIG. 1.

Turning now to FIGS. 1-3, the fuel pump 100 may comprise a housing 102, a camshaft 104 rotatably mounted in the housing 102, and one or more plunger apparatuses 106 (FIG. 2) operatively connected to the camshaft 104.

The housing 102 may include one or more connected components forming a structure that encloses various internal components of the fuel pump 100. The housing 102 may include one or more inlets 103 configured to receive lubrication fluid (LF) supplied from outside of the housing 102. In one embodiment, the lubrication fluid may be oil supplied from an engine 202 (see FIG. 4) by a lubrication supply line 212.

The camshaft 104 (FIG. 2) is formed from an elongated shaft that rotates about an axis X. The camshaft 104 has a first end 108 and a second end 110. The camshaft 104 defines a bore 112 that extends the length of the camshaft 104 from the first end 108 to the second end 110 and provides a channel for the lubrication fluid. In one embodiment, the bore 112 may be generally centered in the camshaft 104 and may be generally straight and without internal pockets that cause pooling or substantial retention of fluid within the bore 112. Other embodiments may utilize other positions and geometries for the bore 112. The first end 108 of the camshaft 104 may be enclosed within the housing 102. An entrance port 114 to the bore 112 may be disposed at the first end 108 of the camshaft 104 and an exit port 116 may be disposed at the second end 110 of the camshaft 104.

The camshaft 104 may include one or more spaced apart interfaces 118. Each interface 118 may be operatively connected to a plunger apparatus 106 in a one-to-one correspondence. In one embodiment, the interface 118 may be a cam lobe, such as an eccentric cam lobe, or the like. In another embodiment, the interface 118 may be a set of two or more cam lobes. As is known in the art, the interfaces 118 may be in phase with one another such that each interface 118 will pass under the bore 112 at the same time, or the interfaces 118 may be out of phase with each other such that a first interface 118 will pass under the bore 112 at a different time than a second interface 118.

The fuel pump may also include a driven gear 120 disposed outside the housing 102 and mounted on the second end 110 of the camshaft 104. The exit port 116 of the bore 112 may be disposed in the center of the driven gear 120.

Each plunger apparatus 106 engages an interface 118 of the camshaft 104 to transform the rotational movement of the interface 118 into reciprocating linear movement of the plunger apparatus 106. Each plunger apparatus 106 is configured, as is known in the art, to increase the pressure of fuel received from a first pressure that is relatively low to a second, higher, pressure that is desirable for the injection of the fuel into the combustion chamber of an engine 202 or other power source. Such injection pressures may vary between different applications.

In one exemplary embodiment, each plunger apparatus 106 comprises a barrel 122 defining a passageway 124, a plunger 126 disposed in the passageway 124, a lifter 128 connected to the plunger 126, an actuator 130 connected to the lifter 128 and a resilient member 134 configured to bias the lifter 128 against the actuator 130. In the embodiment illustrated in FIG. 2, the interface 118 is an eccentric lobe and the actuator 130 is a roller that engages and follows the lobe 118 of the camshaft 104 as the camshaft 104 rotates around axis X. In other embodiments, other types of interfaces 118 and actuators 130 may be used. The resilient member 134 may be a spring that pushes the lifter 128 against the actuator 130 to ensure that the reciprocating motion of the actuator 130 is transferred to the lifter 128 while the camshaft 104 is rotating.

The plunger 126 is operatively connected to the lifter 128 such that the plunger 126 reciprocates within the passageway 124 when the camshaft 104 rotates. When the plunger 126 moves downward, or toward the camshaft 104, during a refilling stroke, fuel is allowed to flow through an opening (not shown) into a pumping chamber 136. The pumping chamber 136 may be disposed at least partially in the passageway 124 above the top 138 of the plunger 126. When the plunger 126 moves upward, or away from the camshaft 104, during a pumping stroke, the fuel is pressurized and is pushed out of the pumping chamber 136 through an outlet (not shown) to a common fuel rail 208 (FIG. 4).

Figure 4:
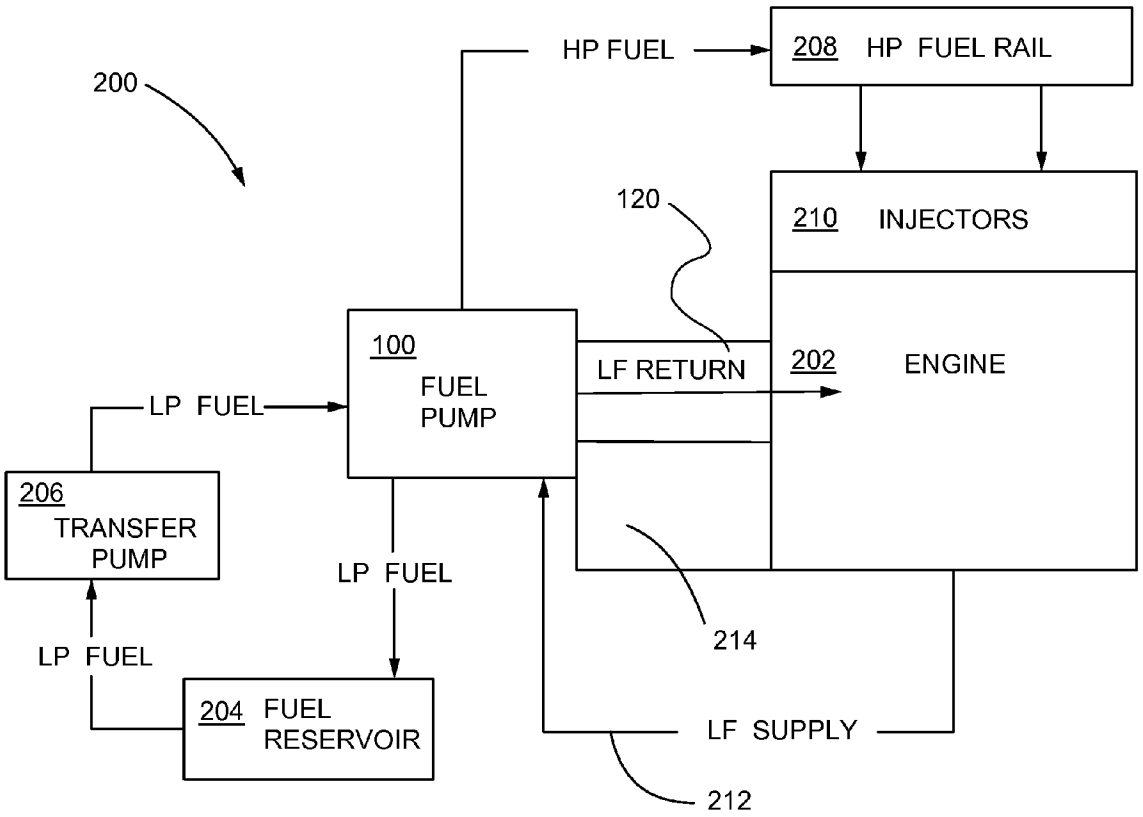
FIG. 4 is a schematic of a common rail fuel system utilizing the fuel pump of FIG. 1.

FIG. 4 illustrates a block diagram of one example of a fuel system 200 that incorporates the fuel pump 100 of the present disclosure. The system may comprise an engine 202 including a plurality of fuel injectors 210, a drive gear 214 operatively connected to the engine 202, a common fuel rail 208 operatively connected the fuel injectors 210 and a fuel pump 100.

The engine 202 may be a compression ignition, diesel engine, or the like, that receives air and fuel into a plurality of combustion chambers during operation. Fuel at a low pressure (LP) is supplied to the fuel pump 100 from a tank or reservoir 204. The reservoir 204 may be connected to a transfer or low pressure pump 206 that pumps fuel out of the reservoir 204 and supplies the fuel to the fuel pump 100. In some embodiments, the fuel pump 100 may be connected to the reservoir 204 such that LP fuel may also exit the fuel pump 100 and return to the reservoir 204.

The driven gear 120 mounted on the camshaft 104 of the fuel pump 100 meshes with a drive gear 214 operatively connected to the engine 202 crankshaft. During operation of the engine 202, the driven gear 120 is rotated by the drive gear which may be coupled to the engine 202 crankshaft, either indirectly through a geartrain or other linkage, or directly.

The first plunger apparatus 106 of the fuel pump may be operatively connected to the common fuel rail 208. A flow of pressurized fuel (HP Fuel) exits the first plunger apparatus 106 of the fuel pump 100 and is delivered to the engine 202 via the common fuel rail 208.

In this exemplary illustration, the fuel pump 100 uses lubrication oil from the engine 202 as lubrication fluid for the lubrication of internal moving components such as the actuators 130 (FIG. 2) that contact the interfaces 118 of the camshaft 104 of the fuel pump 100. For this purpose, a lubrication fluid supply line 212 may circulate a flow of lubrication fluid (oil, in this embodiment) from the engine 202 to the fuel pump 100. The lubrication fluid is drained from the fuel pump 100 back to the engine 202. As can be appreciated, the fuel system 200 as described herein is suited for use any type of engine or power source (e.g., an internal combustion engine, a turbine, etc.)

Also disclosed is method of providing a lubrication fluid sump level 142 for start-up of a fuel pump 100. The method comprises accumulating lubrication fluid in the housing 102 of the fuel pump 100, receiving, through the entrance port 114, accumulated lubrication fluid into the bore 112 in the camshaft 104, and draining the accumulated lubrication fluid out of the exit port 116 of the bore 112. After the draining step is completed and no more lubrication fluid flows out of the exit port 116 of the bore 112, the sump level 142 has been reached. The sump level 142 may be proximal to the lowest point (the "base point" 140) on the circumference of the bore 112. In some embodiments, the sump level 142 may be slightly higher than the base point 140. The method may also include starting the operation of the fuel pump 100 and using the fuel pump 100 to deliver fuel to a common fuel rail 208 operatively connected to the injectors 210 of the engine 202.

INDUSTRIAL APPLICABILITY

The present disclosure may find applicability in draining lubrication fluid from the fuel pump 100 during operation of the engine 202 and in providing desired lubrication to the fuel pump 100 during startup conditions. During operation of the engine 202, lubrication fluid is fed to the fuel pump and excess lubrication fluid is drained out of the fuel pump 100 through the exit port 116.

After shut down of the engine 202, the lubrication fluid is no longer fed to the fuel pump 100 and accumulated lubrication fluid drains out of the fuel pump 100 until the desired sump level 142 is achieved in the fuel pump housing 102. The lubrication fluid accumulated in the fuel pump housing 102 enters the entrance port 114 of the bore 112 and flows through the bore 112 and out of the exit port 116. When no more lubrication fluid flows out of the exit port 116 of the bore 112, the sump level 142 has been reached. The sump level 142 may be proximal to the base point 140 on the circumference of the bore. The path the lubrication fluid takes to exit the fuel pump 100 (entrance port 114 to bore 112 to exit port 116) is the same regardless of whether the engine 202 is shut down or operating.

During start-up and before additional lubrication is provided from the engine 202, the lubrication fluid sump is used to cool moving components in the fuel pump 100. The height of the exit port 116 is a determining factor in the amount of lubrication fluid that remains in the fuel pump housing 102 after the engine 202 has shut down. Draining the lubrication fluid from the fuel pump 100 through the camshaft 104 provides a consistent sump level 142 regardless of the clockwise or counterclockwise orientation of the fuel pump 100 when mounted on the engine 202. For example, a fuel pump 100 that is mounted at a 30° angle from the vertical position will have the same sump level 142 if it had been mounted vertically. This dramatically increases the number of different engines and configurations in which the fuel pump may be utilized and helps to ensure that the volume of the sump level will be adequate to cool components during start up.

In addition, ensuring that the exit port 116 will be at a certain height, regardless of whether the fuel pump 100 mounting has been rotated clockwise or counterclockwise, decreases the possibility that debris near the bottom of the housing 102 may flow from the exit port 116 into the proximity of the meshing gears (drive gear 214 and driven gear 120) because such debris would have to move upward and into the bore 112 in order to be drained out of the pump 100. Another benefit of having the exit port 116 disposed in the center of the driven gear 120, is that any debris that does find its way into the bore 112 will not drain into an area immediately proximal to the meshing of the driven gear 120 and the drive gear 214.

What is claimed is:

1. A fuel pump comprising:

a housing including a first housing end, and a second housing end;

a first plunger apparatus; and a camshaft rotatably mounted in the housing, the camshaft having a first end and a second end, the camshaft defining a bore, the bore having an inner surface extending from the first end to the second end, the inner surface free of apertures and configured to guide accumulated lubrication fluid received at the first end to the second end, the first end enclosed inside the housing, the first end and the first housing end defining a gap sized to allow receipt by the bore of accumulated lubrication fluid from inside the housing, the second end disposed to drain the accumulated lubrication fluid received by the bore at the first end to outside of the second housing end, the camshaft including a first interface operatively connected to the first plunger apparatus.

2. The pump of claim 1, further comprising a driven gear disposed outside the housing and mounted on the second end of the camshaft.

3. The pump of claim 1, wherein the first interface is an eccentric lobe.

4. The pump of claim 1, wherein the bore is generally centered in the camshaft.

5. The pump of claim 1, in which the camshaft further includes a second interface and the pump further includes a second plunger apparatus operatively connected to the second interface of the camshaft.

6. The pump of claim 1, in which the first plunger apparatus includes a barrel defining a passageway, a plunger disposed in the passageway, a lifter connected to the plunger, an actuator connected to the lifter and a resilient member configured to bias the lifter against the actuator.

7. The pump of claim 1, in which the housing includes an inlet configured to receive lubrication fluid supplied from outside of the housing.

8. A fuel system comprising:

an engine including a plurality of fuel injectors;

a drive gear operatively connected to the engine;

a common fuel rail operatively connected to the fuel injectors; and a fuel pump including a housing including a first housing end, and a second housing end;

a first plunger apparatus operatively connected to the common fuel rail;

a camshaft rotatably mounted in the housing, the camshaft having a first end and a second end and defining a bore, the bore having an inner surface extending from the first end to the second end, the inner surface free of apertures and configured to guide accumulated lubrication fluid received at the first end to the second end, the inner surface free of apertures and configured to guide accumulated lubrication fluid received at the first end to the second end, the first end enclosed inside the housing, the first end and the first housing end defining a gap sized to allow receipt by the bore of accumulated lubrication fluid from inside the housing, the second end disposed to drain the accumulated lubrication fluid received by the bore at the first end to outside of the second housing end, the camshaft including a first interface operatively connected to the first plunger apparatus; and a driven gear disposed outside the pump housing and mounted on the second end of the camshaft and meshed with the drive gear.

9. The system of claim 8, wherein the bore is substantially centered in the camshaft.

10. The system of claim 8, wherein the first interface is an eccentric lobe of the camshaft.

11. The system of claim 8, wherein the first plunger apparatus includes a barrel defining a passageway, a plunger disposed in the passageway, a lifter connected to the plunger, an actuator connected to the lifter and a resilient member configured to bias the lifter against the actuator.

12. A method of providing a lubrication fluid sump level for start-up of a fuel pump, the method comprising:

accumulating lubrication fluid in a housing of the fuel pump, the housing including a first housing end, and a second housing end;

receiving, through an entrance port, accumulated lubrication fluid from inside the housing into a bore in a camshaft, the camshaft rotatably mounted in the fuel pump and having a first end and a second end, the entrance port of the bore disposed at the first end of the camshaft, the bore having an inner surface extending from the first end to the second end, the inner surface free of apertures and configured to guide the received accumulated lubrication fluid to the second end, the first end enclosed inside the housing, the first end and the first housing end defining a gap sized to allow receipt by the bore of accumulated lubrication fluid from inside the housing; and draining the accumulated lubrication fluid out of the housing through an exit port of the bore, the exit port disposed at the second end of the camshaft.

13. The method of claim 12, wherein after the draining step is completed, the lubrication fluid sump level is proximal to a base point on the circumference of the bore.

14. The method of claim 13, further comprising starting the operation of the fuel pump.

15. The method of claim 12, wherein the exit port is disposed in the center of a driven gear mounted outside the housing on the second end of the camshaft.

16. The method of claim 12, further comprising using the fuel pump to deliver fuel to a common fuel rail operatively connected to injectors of an engine.

17. The method of claim 12, wherein the bore is substantially centered along the length of the camshaft.

18. The method of claim 12, wherein the fuel pump includes a plurality of plunger apparatuses, each plunger apparatus operatively connected to the camshaft and operatively connected to a common fuel rail of a common rail fuel system.

19. The method of claim 12, wherein the second end of the camshaft is enclosed in the housing.

* * * * *